US006409856B1

(12) United States Patent
Wiemann

(10) Patent No.: US 6,409,856 B1
(45) **Date of Patent: *Jun. 25, 2002**

(54) APPARATUS FOR SMOOTHING OUT THE SURFACE WEIGHT DISTRIBUTION OF MATS

(75) Inventor: Dieter Wiemann, Barsinghausen (DE)

(73) Assignee: Bison-Werke Baehre & Greten GmbH & Co. KG, Springe (DE)

( * ) Notice: Subject to any disclaimer, the term of this patent is extended or adjusted under 35 U.S.C. 154(b) by 0 days.

This patent is subject to a terminal disclaimer.

(21) Appl. No.: 08/410,182

(22) Filed: Mar. 24, 1995

(30) Foreign Application Priority Data

Feb. 2, 1995 (DE) ..... 195 03 407

(51) Int. Cl.[7] ..... B27N 3/02; B27N 5/00

(52) U.S. Cl. ..... 156/62.2; 264/112; 264/116; 264/118; 264/119; 264/162; 425/81.1; 425/82.1; 425/83.1; 425/299

(58) Field of Search ..... 156/62.2; 425/81.1, 425/82.1, 83.1, 299; 264/113, 116, 118, 119, 162, 112

(56) References Cited

U.S. PATENT DOCUMENTS 1,952,208 A * 3/1934 Hussey ..... 264/116
2,635,301 A * 4/1953 Schubert et al. ..... 425/83.1
2,822,024 A * 2/1958 Himmelheber et al.
3,665,065 A * 5/1972 Hass et al. ..... 264/113
4,360,333 A * 11/1982 Fox et al. ..... 425/299
4,675,144 A * 6/1987 Hammond ..... 264/162

* cited by examiner

*Primary Examiner*—Michael W. Ball
*Assistant Examiner*—Sam Chuan Yao
(74) *Attorney, Agent, or Firm*—Townsend and Townsend and Crew LLP

(57) ABSTRACT

An apparatus is described for smoothing out the surface weight distribution of one or multilayer mats containing lignocellulose and/or cellulose with a binding agent dispersed therein for manufacturing of shaped articles, in particular in the form of wood chipboard, wood fiberboard or the like, wherein at least one vertically adjustable reverse brushing unit which extends over the width of the web is associated with a mat carrier which is fed via at least one scattering head. This apparatus is characterized, above all, by the reverse brushing unit comprising at least one vertically adjustable brushing roller having flexible bristles of a plastic material such as polypropylene, Teflon or the like which cooperates with a cleaning brush or a cleaning strip.

6 Claims, 2 Drawing Sheets

APPARATUS FOR SMOOTHING OUT THE SURFACE WEIGHT DISTRIBUTION OF MATS

The invention relates to an apparatus for smoothing out the surface weight distribution of one or multilayer mats containing lignocellulose and/or cellulose with a binding agent dispersed therein for the manufacture of shaped articles, in particular in the form of wood chipboard, wood fiberboard or the like. A vertically adjustable reverse brushing unit extends over the width of the web and is associated with a mat carrier which is fed or charged via at least one scattering head.

BACKGROUND OF THE INVENTION

In the apparatus known to the Applicant from EP-PS 0 336 098 B1, a distribution unit for the variable deflection of the incident mat particles is disposed in the mat particle return scattering path in front of the reverse brushing unit as seen in the running direction of the mat. The distribution unit consists here of several pendulum-like flaps arranged alongside one another. The axes of the flaps preferably extend perpendicular to the mat carrier and are coupled in phase, or at least partly phase-displaced, to a common drive.

In contrast, the reverse brushing unit expediently consists of a reverse brushing scattering roller extending over the width of the mat with its axis extending parallel to the mat carrier and perpendicular to the running direction of the mat carrier. The reverse brushing scattering roller is preferably driven at a high speed of rotation, with an expedient rotary speed lying for example at 300 rpm. In operation of this known apparatus it was found that in the course of time undesired accumulation processes and baking on processes occurred at the reverse brushing scattering roller and at the pendulum flaps, in particular when manufacturing gypsum and/or cement-bound board-like products, and that these accumulation and baking-on processes disturb the problem free smoothing of the surface weight distribution of one or multilayer mats and also require cleaning work which is time-consuming and expensive.

SUMMARY OF THE INVENTION

The invention is thus based on the object of providing an apparatus of the initially named kind which permits an operationally reliable and more uniform surface weight distribution of one or multilayer mats. This object is satisfied in accordance with the invention by an apparatus in which a vertically adjustable reverse brushing roller extends at least over a part of the width of the web. The vertically adjustable reverse brushing roller has flexible bristles of hydrophobic material associated with a mat carrier which is fed via at least one scattering head. The reverse brushing roller cooperates with a cleaning brush with flexible bristles running in the opposite direction, or with a cleaning strip. The cleaning brush is an apparatus for receiving and returning the rearwardly brushed mat particles to the metering bunker of the respective scattering head provided in the region of the reverse brushing roller.

If the reverse brushing roller is set with flexible bristles of the same length then a very accurate surface weight distribution of a flat one or multilayer mat arises, with a problem free interplay with the measuring apparatus and the apparatus for receiving and returning the brushed back mat particles.

Since, in the apparatus of the invention, operation always takes place with an excess of particles, even greater irregularities in the scattered bulk material can be compensated for without problem. This also has the consequence that no high requirement need be placed on the metering accuracy, because the reverse brushing roller always brings about the required volumetric compensation.

In the event of the preferred oblique positioning of the reverse brushing roller or rearward brushing roller with respect to the running direction of the respective mat carrier, one obtains the advantages of an advantageous additional mixing of the particles, of an improvement in the uniformity of the particles and also of more rapid discharge transport of the particles from the reverse brushing rollers back to the metering bunker of the respective scattering head.

An advantageous variant of the invention resides in that the reverse brushing roll can be so vertically adjustably fixed relative to the mat carrier that a mat of trapezium shape in cross-section can be generated for pressing into roof shingles and similarly shaped bodies.

In this connection it is particularly advantageous to arrange a reverse brushing unit above a profiled mat carrier which is of mirror image-like double wedge shape in cross-section, with the reverse brushing unit consisting of two reverse brushing rollers which in plan view form a displaced V-shaped arrangement. In this way a mat which is of double trapezium shape in cross-section can be manufactured which can be subdivided after a subsequent pressing procedure into two correspondingly shaped bodies. It is moreover important to the invention that the flexible brushes of the reverse brushing roll can also be of different lengths in order to give a mat a desired surface structure if, for example, one wants to manufacture a decorative wall plate or panel from it.

Advantageous design features and further embodiments of the invention are set forth in the subordinate claims.

BRIEF DESCRIPTION OF THE DRAWINGS

The invention will be explained in more detail in the following with reference to a drawing which simply shows embodiments. In this drawing there are shown.

DESCRIPTION OF THE PREFERRED EMBODIMENTS

Figure 1:
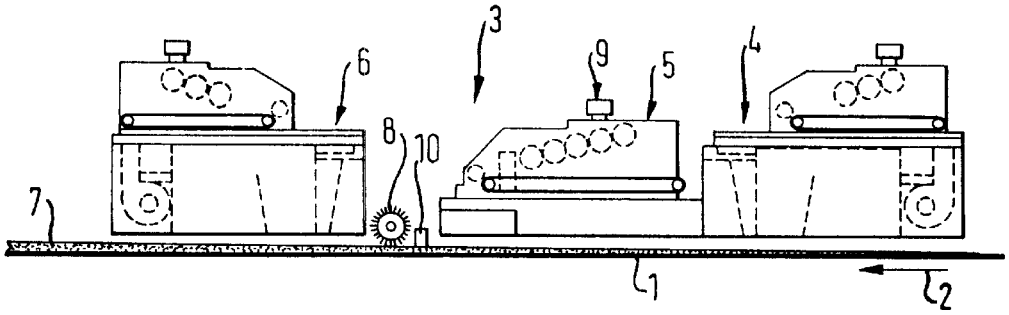
FIG. 1 is a schematic illustration of a scattering station for the formation of a multilayer mat with the apparatus of the invention for making the surface weight distribution of the middle layer of the mat more even.

FIG. 1 shows a section of an endless mat carrier 1 which is moved in the direction of the arrow 2 beneath the scattering station which is designated as a whole with the reference numeral 3. The scattering station 3 includes a unit 4 for forming the lower covering layer, a unit 5 for forming the middle layer, and a unit 6 for forming the upper cover layer of the mat 7.

A vertically adjustable reverse brushing roller 8 is arranged obliquely over the width of the mat at least between the units 5 and 6. The reverse brushing roller 8 rotates contrary to the direction of movement 2 of the mat carrier and renders the surface weight distribution of the middle layer of the mat 7, i.e. the weight per unit area of the middle layer of the mat 7, more uniform. Excess rearwardly brushed particles of the middle layer mat are led off sideways and transferred to a transverse conveyor 33 located beneath the mat carrier 1. The transverse conveyor 33 transports the rearwardly brushed material, which can come from the reverse brushing roller 8 or also from the brushing rollers 19, 20 used to form the edges, to the metering bunker 9 of the unit 5 or to a further conveyor apparatus, the discharge end of which terminates in the metering bunker 9. A measuring apparatus 10, which is preferably formed as a traversing measuring apparatus 10 and which serves to adjust the vertical position of the reverse brushing roller 8 in dependence on the desired weight per unit area distribution in the transverse direction of the mat 7, is mounted directly in front of the reverse brushing roller 8.

Figure 2:
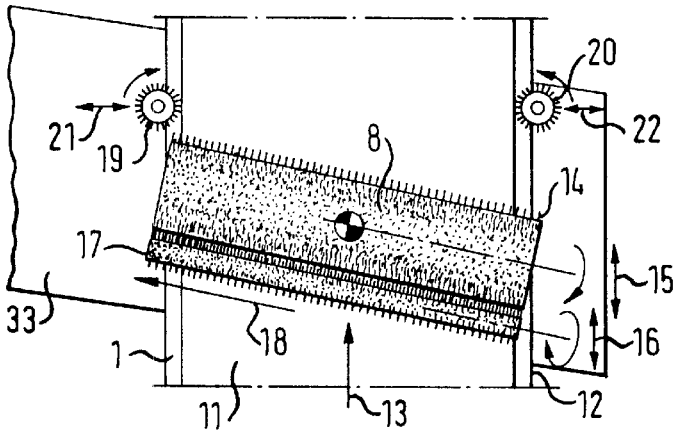
FIG. 2 is a schematic plan view of a reverse brushing unit with brush cleaning and associated roller brushes for trimming the long edges of the mat.

With reference to FIG. 1, FIG. 2 illustrates in a plan view a middle layer 11 of a mat which is moved in the direction of the arrow 13, together with a mat carrier, which can consist of individual underlay plates or trays 12. A vertically adjustable reverse brushing roller 8 with flexible bristles 14 of a plastic material is arranged over the width of the mat in a selectable inclined position to which the double arrow 15 refers. For the purpose of cleaning the rotating reverse brushing roller 8 a counter-rotating brush roller 17 engages into it in the same inclined position 16, with the counter-rotating brush roller 17 preferably likewise having flexible brushes 14 of a plastic material. All the thereby occurring excess mat particles are moved on in the direction of the arrow 18 and are picked up laterally outside of the underlay plates 12 by a suitable transport device, be it a screw conveyor or, as shown in the example, a band conveyor, and—see FIG. 1—are conveyed back into the metering bunker 9 of the unit 5 of the scattering station 3.

FIG. 2 also shows two roller brushes 19 and 20 for bounding and defining the longitudinal edges of the middle layer 11 of a mat. The roller brushes 19 and 20 are movable towards and away from one another in the direction of the double arrows 21 and 22 so that they can form the longitudinal edges of middle layers 11 of mats of different widths. The loose edging material is treated in the same way as the material which arises on reverse brushing by the reverse brushing roller 8, i.e. it is transported into the metering bunker 9 of the unit 5 of the scattering station 3 and indeed through the intermediary of the transverse conveyor 33.

Figure 3:
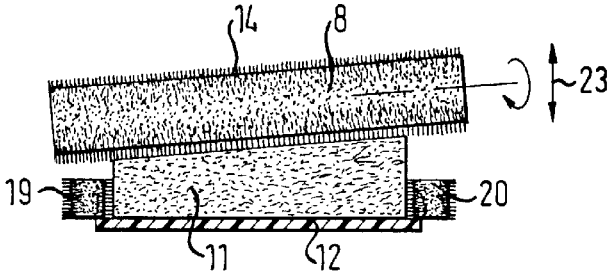
FIG. 3 is a schematic view of the subject of FIG. 2 in the transverse direction of a mat.

In accordance with FIG. 3 the reverse brushing roller 8 is variably adjustable height-wise in accordance with the direction of the double arrow 23. In this way one obtains a mat 11 which is of trapezium shape in cross-section which is suitable for being pressed into a shingle.

Figure 4:
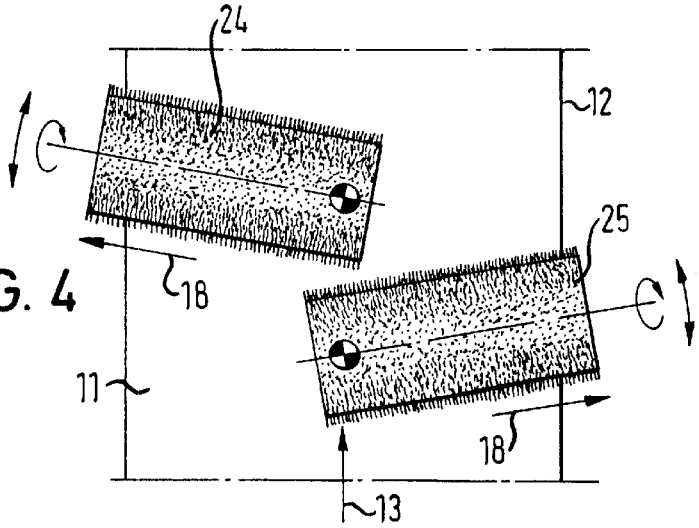
FIG. 4 is a schematic plan view of two reverse brushing rollers in accordance with the invention in a displaced V-shaped arrangement.

FIG. 4 shows, above all, two reverse brushing rollers 24 and 25 in a displaced V-shaped arrangement which are adjustable analogously to the reverse brushing roller 8 of FIGS. 2 and 3 and which each have a counter-rotating brush roller 17 which is however partly not shown for the sake of simplicity.

Figure 5:
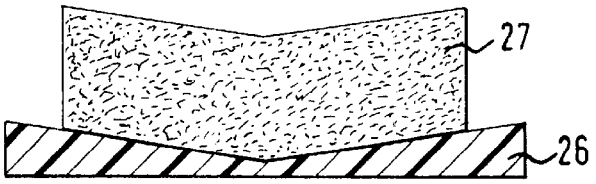
FIGS. 5 to 7 are cross-sectional views of a mat formed on a mat carrier which has a uniform surface weight distribution following the reverse brushing and is then pressed into a shaped body.
Figure 6:
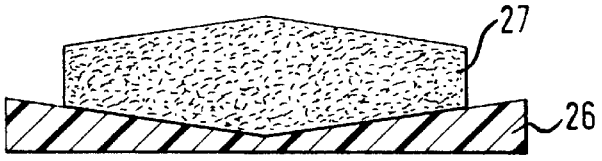
Figure 7:
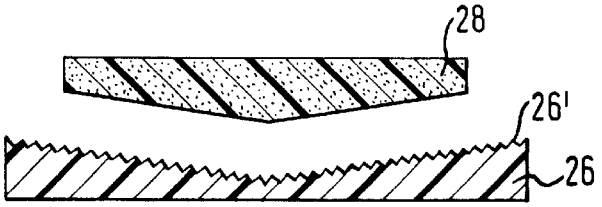

Starting from a web 27 formed in accordance with FIG. 5 on a mat carrier 26 which has been profiled to be of mirror image-like double wedge shape in cross-section, this embodiment of the invention ensures that this mat 27 adopts a double trapezium shape in cross-section, in accordance with FIG. 6, after reverse brushing, and has a surface weight distribution which has been rendered more uniform. The shaped body 28 which is manufactured from it in a pressing process can be seen from FIG. 7. It is characterized by a uniform weight per area throughout and is subdividable by a central cut into two shingles. The surface of the mat carrier 26 is preferably of ribbed shape so that shingles manufactured using this mat carrier 26 also receive a corresponding surface structure.

Figure 8:
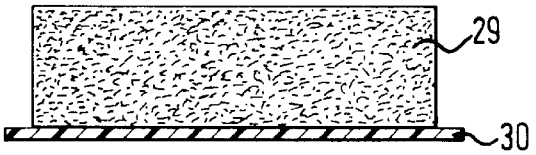
FIGS. 8 to 10 are schematic views of a mat formed on a mat carrier which is to be subjected, with a uniform surface weight distribution, to surface profiling to form the finally pressed shaped body.
Figure 9:
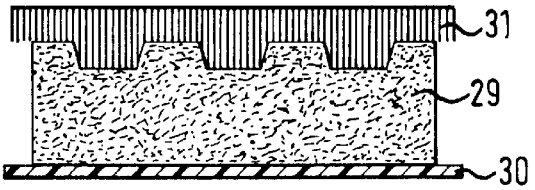
Figure 10:
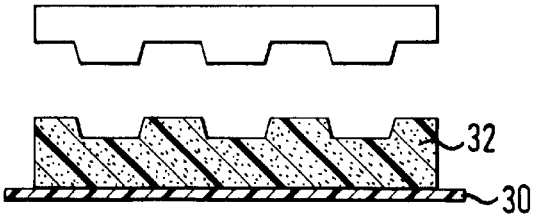

FIG. 8 shows a mat 29 which is located on a planar mat carrier 30. This mat 29 receives a corresponding surface profile, in accordance with FIG. 9, by means of flexible bristles 31 of the reverse brushing roller 8 of different lengths, as well as a surface weight distribution which has been rendered uniform and results, in accordance with FIG. 10, in a shaped body 32 of constant weight per unit area following a pressing procedure.

What is claimed is:

1. Apparatus for smoothing a surface of a mat having at least one layer including at least one of lignocellulose particles and cellulose particles and a binding agent dispersed therein for manufacturing shaped articles, the apparatus comprising a mat carrier for moving the mat in a given direction; first and second reverse brushing rollers extending at least over a part of a width of the mat and being adjustable relative to the mat carrier in at least one of a horizontal direction and a vertical direction, the reverse brushing rollers having flexible bristles, the bristles being positioned so that they contact the mat and the brushing roller rotating in a direction so that the bristles contacting the mat move in a direction opposite to the given direction, the first and second reverse brushing rollers being further axially inclined with respect to each other to form a V-shaped roller arrangement and displaced with respect to each other in the given direction; at least one scattering head and a metering bunker associated therewith located in a region of the reverse brushing roller; one of a cleaning strip and a cleaning brush cooperating with each reverse brushing roller, the cleaning brush having flexible bristles and rotating in a direction opposite to the direction of rotation of the reverse brushing roller; and means for receiving and returning particles removed from the mat to the metering bunker.

2. Apparatus according to claim 1 wherein the carrier defines a flat carrier surface.

3. Apparatus according to claim 1 and including means for forming at least a portion of a surface of the mat spaced from the carrier surface so that the portion of the mat surface is angularly inclined relative to the carrier surface.

4. Apparatus according to claim 3 and including means for shaping at least one longitudinally extending groove in the surface of the mat spaced from the carrier surface.

5. Apparatus for smoothing a surface of a mat having at least one layer including one of lignocellulose particles and cellulose particles and a binding agent dispersed therein for manufacturing shaped articles, the apparatus comprising an elongated mat carrier for moving the mat longitudinally in a given direction, the mat carrier including a mat carrying surface defined by first and second surface portions which are sloped from a center region of the carrier to lateral sides thereof so that the carrying surface forms an obliquely angled, centrally symmetrical wedge channel; an adjustable reverse brushing roller extending at least over a part of a width of the mat and having flexible bristles, the bristles being positioned so that they contact the mat and the brushing roller rotating in a direction so that the bristles contacting the mat move in a direction opposite to the given direction; at least one scattering head and a metering bunker associated therewith located in a region of the reverse brush roller; one of a cleaning strip and a cleaning brush cooperating with the reverse brushing roller, the cleaning brush having flexible bristles and rotating in a direction opposite to the direction of rotation of the reverse brushing roller; and means for receiving and returning particles removed from the mat to the metering bunker.

6. Apparatus according to claim 5 wherein the first and second carrier surface portions include longitudinally extending serrations.

* * * * *